US005527240A

United States Patent [19]

Chen

[11] Patent Number: 5,527,240

[45] Date of Patent: Jun. 18, 1996

[54] GRIPPING POWER TRAINING DEVICE

[76] Inventor: Chun N. Chen, No. 3, Lane 232, Sec. 2, Kuai Yang St., Taipei, Taiwan

[21] Appl. No.: 504,151

[22] Filed: Jul. 19, 1995

[51] Int. Cl.[6] ..... A63B 21/02; A63B 21/00

[52] U.S. Cl. ..... 482/44; 482/49; 482/112

[58] Field of Search ..... 482/44, 49, 111, 482/112, 148, 45, 46, 50

[56] References Cited

U.S. PATENT DOCUMENTS

| | | | |
|---|---|---|---|
| 468,154 | 2/1892 | McClure | 482/49 |
| 689,652 | 12/1901 | Perry | 482/49 |
| 4,772,016 | 9/1988 | Manion | 482/112 |
| 4,832,335 | 5/1989 | Tong | 482/112 |
| 5,317,916 | 6/1994 | Kovacevic | 482/49 |

*Primary Examiner*—Stephen R. Crow
*Attorney, Agent, or Firm*—Morton J. Rosenberg; David I. Klein

[57] ABSTRACT

A gripping power training device includes a first holding component, a second holding component and at least two washers, in which a holding part the surface of which is undulated is installed on the top of the first holding component, and two pushing sticks are installed on two sides of the holding part respectively. An annular groove is formed on the end of each pushing stick for being engaged with the washer. The other holding part the shape of which is the same with that of the first holding component is installed on the top of the second holding component the appearance of which is similar to the first holding component, two cylindrical tanks the inner diameters of which are slightly larger than the diameters of the pushing sticks are installed on the bottom of the holding part for being inserted by the pushing stick of the first holding component and forming a sealed state between them. Then, the air compressed resistance is formed in the cylindrical tank when the first and the second holding components are pushed towards each other, the released elasticity is formed by the compressed air in the cylindrical tank when the first and second holding components are released, thus a gripping power training device is constructed.

4 Claims, 4 Drawing Sheets

GRIPPING POWER TRAINING DEVICE

BACKGROUND OF THE INVENTION

This invention relates to a new structure of gripping power training device, it particularly relates to a training device for the gripping power of the hand and an air compressing and releasing structure which is constructed by at least two pushing sticks matching with cylindrical tanks.

DESCRIPTION OF THE PRIOR ART

The stamina training really plays an important role for the working people in modem society, the simpler training activities, such as the strength training of the arm, the wrist, and the hand, are paid much attention to after the sport is pushed by the government, in which the gripping power training is the simplest and occupies small space, so it is the most popular activity.

The conventional gripping power training device is installed with a metal spring between the holding parts for forming the compressed and released elasticity between them, the holding part is held by the operator, and the elasticity is used to train the gripping power of the hand.

The conventional gripping power training device providing compressed and released elasticity by the spring, in structure, needs to fix and bend the spring in certain range for forming the needed elasticity, so the accessories such as the slotting, elastic lamella, etc. are very complicate in assembly, and it is also not easy to be assembled because of the restriction of the elasticity. Furthermore, because it uses the compressed and released elasticity of the spring, the hand of the operator is easy to be hurt by the gap of the spring when the spring is compressed or released, which largely decreases the efficiency of using, besides, the metal rust and the elastic fatigue of the spring are easily produced after using it for a long time, which largely shortens the life of using the device.

SUMMARY OF THE INVENTION

The main object of the invention is to provide a new gripping power training device, in which the first holding component has an undulated holding part providing a comfortable holding state, two pushing sticks are installed on two sides of the bottom of the holding part respectively, and an annular groove is formed on the end of the pushing stick for engaging with the washer. The second holding component has a similar appearance to the first holding component, the same holding part with that of the first holding component is also provided on it, and two cylindrical tanks the inner diameters of which are slightly larger than the diameters of the pushing sticks are installed on the sides of the bottom of the holding parts respectively for being inserted by the pushing sticks and forming a sealed state. Then, a compressed resistance is formed by the air in the cylindrical tank when the first and second holding components are pushed towards each other, and a released elasticity is formed by the compressed air in the tanks when the holding components are released. In other words, the compressed and released elasticity between the first and second holding components are provided by the air pressure in the sealed cylindrical tank, so the disadvantages of metal rust and elastic fatigue are eliminated, which increases the efficiency and life of using and improves the drawbacks and troubles easily produced in the conventional training device.

The foregoing summary, as well as the following detailed description of the preferred embodiments, is better understood when read in conjunction with the appended diagrammatic drawings.

DESCRIPTION OF THE FIGURES

Figure 1:
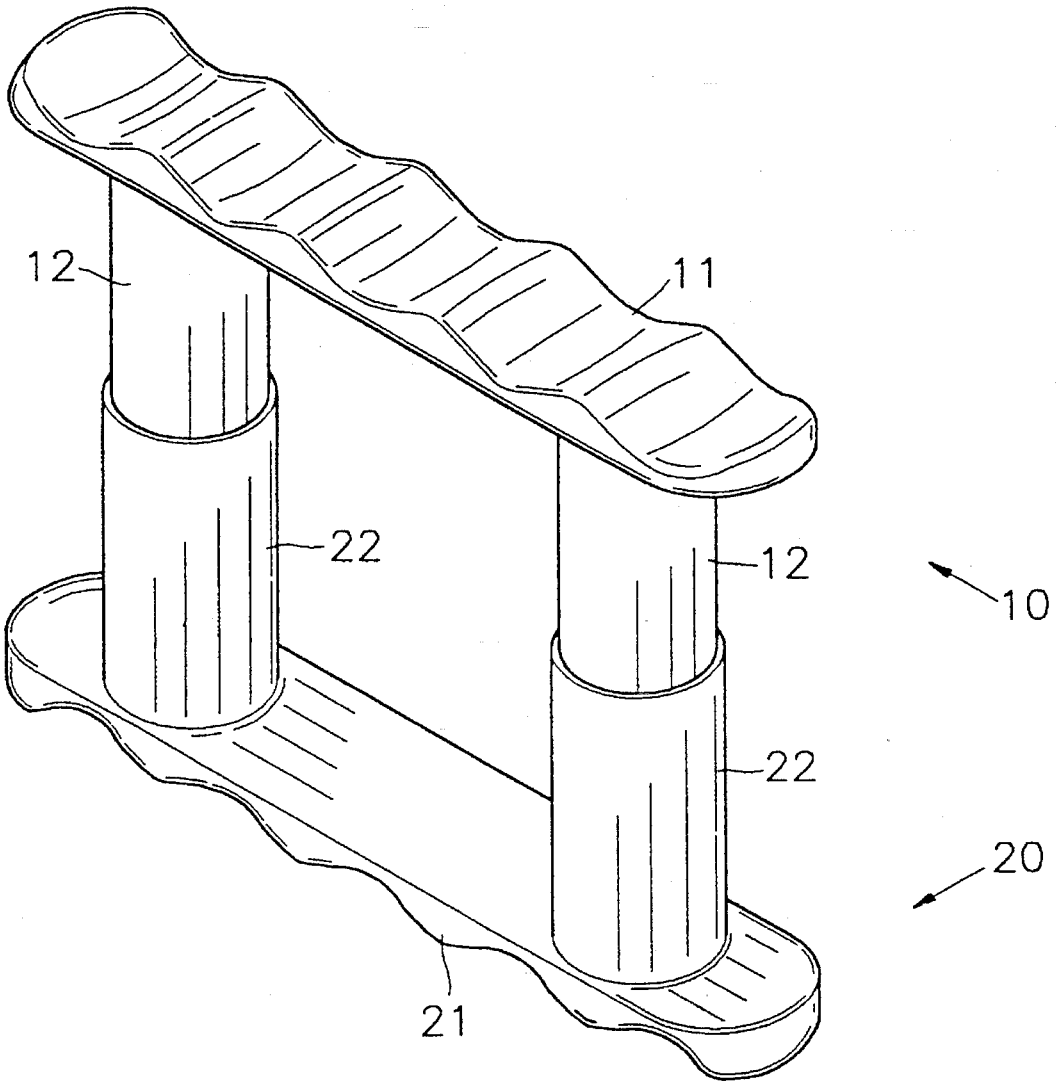
FIG. 1 is a perspective view of the invention.

10. first holding component 11. holding part
12. pushing stick 121. annular groove
13. washer 20. second holding component
21. holding part 22. cylindrical tank

DETAILED DESCRIPTION OF THE INVENTION

Figure 2:
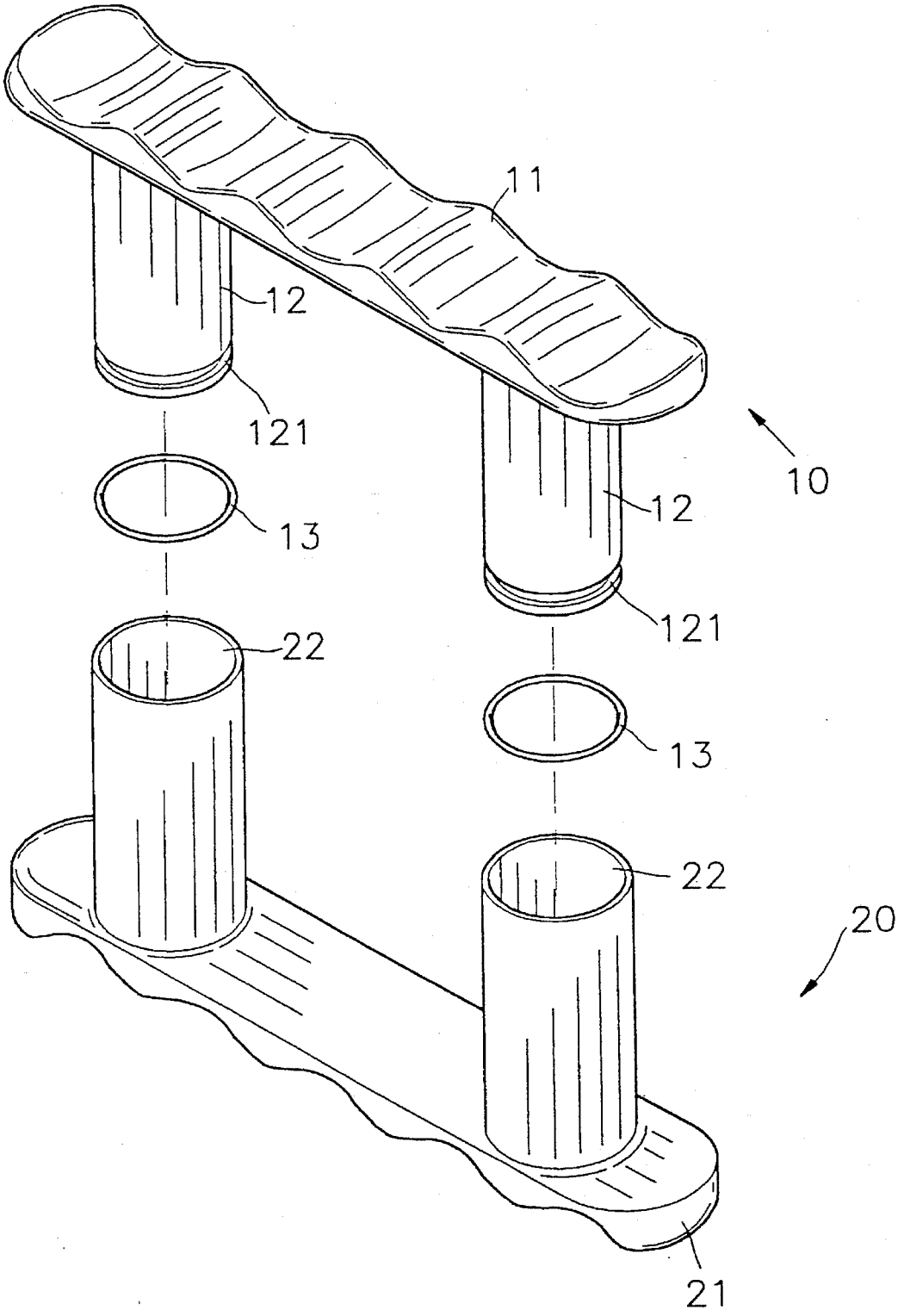
FIG. 2 is a perspective diagram showing the construction of the invention.
Figure 3:
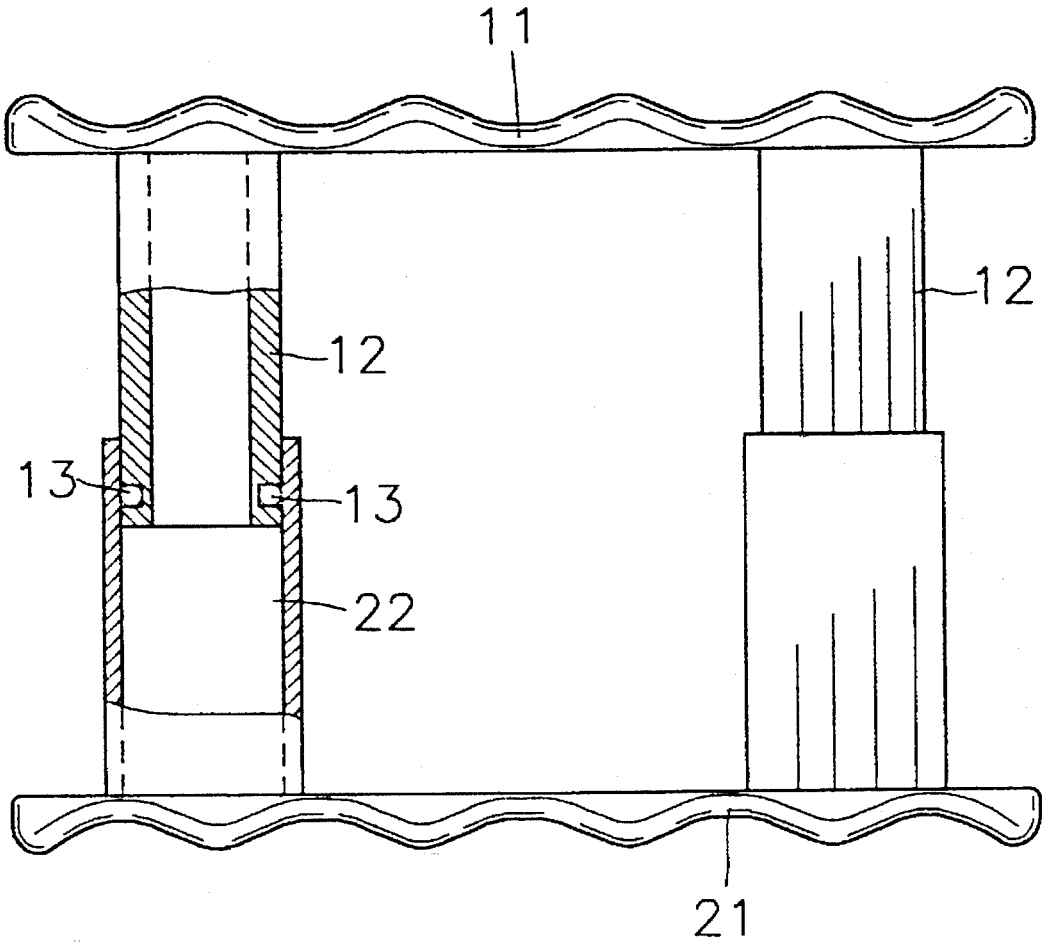
FIG. 3 is a sectional view of the invention.

As shown in FIGS. 1, 2, and 3, the gripping power training device in this invention includes a first holding component 10 the appearance of which looks like an inverse U, wherein a holding part 11 is formed on the top of the holding component 10, the surface of it is undulated for matching with the fingers and providing a comfortable grip. A pushing stick 12 is installed downwards on each side of the bottom of the holding part 11, it can be hollow or solid, and at least one annular groove 121 is formed on the end of it. A washer 13 matching with the annular groove 121 is provided for being engaged with the annular groove 121.

The second holding component 20 the appearance of which is similar to the first holding component 10 is installed, on the top, with a holding part 21 the shape of which is the same with that of the first holding component 10, two cylindrical tanks 22 the inner diameters of which are slightly smaller than the diameter of the pushing stick 12 are installed downwards on two sides of the bottom of the holding part 21 respectively, and it is used for being inserted by the pushing stick 12 to form a sealed structure through the use of the washer as shown in FIG. 3. The air pressure in the inner space is the normal atmosphere pressure, there is no pressure difference between the holding parts 11, 21 of the first holding component 10 and the second holding component 20.

As illustrated in FIGS. 1, 2, and 3, when operating the training device in this invention, the holding parts 11, 21 of the first holding component 10 and the second holding component 20 are used to be held by the thumb and the other four fingers respectively. Pushing the holding parts 11, 21 towards each other by the hand of the operator, the pushing stick 12 is pushed into the cylindrical tank 22, and then the volume in the cylindrical tank 22 and the pushing stick 12 is instantaneously decreased, thus the air pressure in the inner space is increased (this pressure is larger than the outside atmosphere pressure, it is because that the air pressure times the air volume is a constant value). Then, there is a compressed resistance between the holding parts 11, 21 of the first and second holding components 10, 20, so the hand will feel a resistance when gripping and pressing the device. At this time, if the operator releases the holding parts 11, 21 of the first holding component 10 and the second holding component 20, the compressed air pressure in the pushing stick 12 and the cylindrical tank 22 is instantaneously released towards the holding parts 11, 21, then, the pushing stick 12 inserted into the cylindrical tank 22 is pushed and return to the original place as shown in FIG. 3, thus the object of training the gripping power is achieved. In other words, the training movement of gripping can be accomplished by the structure of compressed or released air pressure in this invention, it not only eliminates the disadvantages of metal rust and elastic fatigue, but also has simple accessories, thus the product is easily manufactured and assembled. Besides, the gripping force is kept to a constant on each gripping training, which will increase the using effect and improve the disadvantages and troubles happened in the conventional training device.

Figure 4:
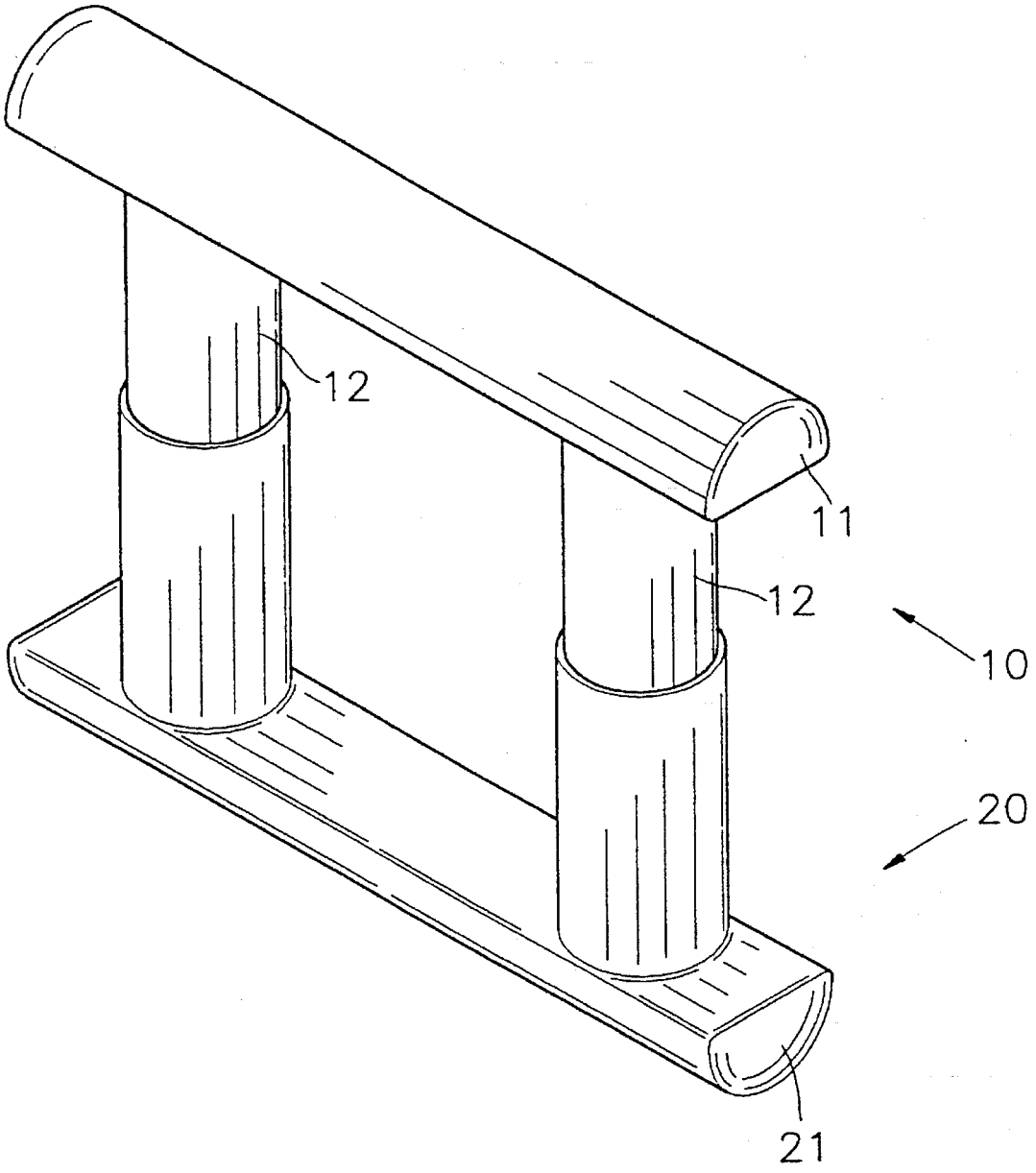
FIG. 4 is a diagram showing the preferred embodiment of the invention.

Referring to FIG. 4, the gripping power training device shown in FIGS. 1, 2, and 3 can be produced as the structure shown in FIG. 4, the sectional shape of the holding parts 11, 21 of the first holding component 10 and the second holding component 20 is a semicircle, it is also able to achieve the object of comfortable gripping.

Having described preferred embodiments of a new and improved design for the gripping power training device in accordance with the present invention, it is believed that other modifications, variations and changes will be suggested to persons skilled in the art in view of the teachings set forth herein. It is therefore to be understood that all such variations, modifications and changes are believed to fall within the scope of the present invention as defined by the appended claims.

I claim:

1. A gripping power training device, comprising:

a first holding component including a holding pan on the top and two pushing sticks installed downwards on two sides of the bottom of said holding part;

at least one annular groove formed on the end of said pushing sticks;

two washers, having the same shape matching with said annular grooves of said first holding component, used to be engaged with said annular groove;

a second holding component the appearance of which is similar to said first holding component;

a holding pan formed on the top of said second holding component; and two cylindrical tanks, having inner diameters which are slightly larger than the diameters of said pushing sticks of said first holding component, installed downwards on the bottom of said holding pan of said second holding component for being inserted by said pushing sticks of said first holding component and forming a sealed structure with said pushing sticks by said washers;

wherein, said holding parts of said first holding component and said second holding component are used for being held, the volume and the air pressure in said pushing sticks and said cylindrical tanks are changed by pressing said holding pans towards each other, and an air compressed resistance is formed in said holding part; and the air released elasticity is formed by the recovering phenomenon of the air pressure and volume in said pushing sticks and said cylindrical tanks to the original state after said holding parts are released by the hand of the operator.

2. The device as set forth in claim 1, wherein the shapes of said first holding component and said second holding component look like an inverse U.

3. The device as set forth in claim 1 or claim 2, wherein the surfaces of said holding pans of said first holding component and said second holding component are undulated.

4. The device as set forth in claim 1 or claim 2, wherein the sectional shape of said holding parts of said first holding component and said second holding component can be a semicircle.

* * * * *